US007767959B1

(12) United States Patent
Freidhoff

(10) Patent No.: US 7,767,959 B1
(45) **Date of Patent: *Aug. 3, 2010**

(54) MINIATURE MASS SPECTROMETER FOR THE ANALYSIS OF CHEMICAL AND BIOLOGICAL SOLID SAMPLES

(75) Inventor: Carl B. Freidhoff, New Freedom, PA (US)

(73) Assignee: Northrop Grumman Corporation, Los Angeles, CA (US)

( * ) Notice: Subject to any disclaimer, the term of this patent is extended or adjusted under 35 U.S.C. 154(b) by 398 days.

This patent is subject to a terminal disclaimer.

(21) Appl. No.: 11/802,196

(22) Filed: May 21, 2007

(51) Int. Cl.
*H01J 49/00* (2006.01)

(52) U.S. Cl. ..... 250/288; 250/287

(58) Field of Classification Search ..... 250/281, 250/287, 288, 289

See application file for complete search history.

(56) References Cited

U.S. PATENT DOCUMENTS 5,367,163 A * 11/1994 Otsuka et al. ..... 250/288
5,386,115 A 1/1995 Freidhoff et al.
6,188,067 B1 * 2/2001 Chutjian et al. ..... 250/292
6,469,298 B1 * 10/2002 Ramsey et al. ..... 250/292
7,208,729 B2 * 4/2007 Syms ..... 250/288
7,388,195 B2 * 6/2008 Zapata et al. ..... 250/288
7,435,950 B2 * 10/2008 Miller et al. ..... 250/287
2005/0230615 A1 * 10/2005 Furutani et al. ..... 250/287
2007/0205361 A1 * 9/2007 Russ et al. ..... 250/288
2008/0001082 A1 * 1/2008 Syms et al. ..... 250/288
2008/0283742 A1 * 11/2008 Takeuchi et al. ..... 250/288
2009/0189064 A1 * 7/2009 Miller et al. ..... 250/282

* cited by examiner

*Primary Examiner*—Robert Kim
*Assistant Examiner*—Brooke Purinton
(74) *Attorney, Agent, or Firm*—Andrews Kurth LLP

(57) ABSTRACT

Analysis of solid chemical and biological particles is achieved by a miniature mass spectrometer and apparatus attached thereto for vaporizing or ablating a stream of chemical and biological particles by a pulsed laser and/or pyrolysis heater sub-assembly at atmospheric pressure or, when desirable, in a vacuum. The mass spectrometer includes a collimation chamber, a repeller assembly, an internal ionization chamber, a mass filter and ion separation chamber, a drift space region, and a multi-channel ion detection array so as to permit the collection and analysis of ions formed over a wide mass range simultaneously. The apparatus for vaporizing or ablating includes an output port adjacent the input to the collimation and vaporization chamber so as to maximize the amount of vaporized material being fed into the mass spectrometer.

24 Claims, 5 Drawing Sheets

MINIATURE MASS SPECTROMETER FOR THE ANALYSIS OF CHEMICAL AND BIOLOGICAL SOLID SAMPLES

CROSS REFERENCE TO RELATED APPLICATIONS

This invention is related to the invention shown and described in U.S. Ser. No. 11/802,183 (Northrop Grumman Case No. 001631-078) entitled "Miniature Mass Spectrometer For The Analysis Of Biological Small Molecules", filed in the name of Carl B. Freidhoff, the present inventor on May 21, 2007. This application is assigned to Northrop Grumman Corporation, the present assignee.

This invention is also related to the invention shown and described in U.S. Ser. No. 11/260,106 (Northrop Grumman case No. 000810-078) entitled "A MEMs Mass Spectrometer", filed in the name of Carl B. Freidhoff on Oct. 28, 2005. This application is also assigned to Northrop Grumman Corporation.

The teachings of the above cross-referenced patent applications are intended to be incorporated herein by reference for any and all purposes.

BACKGROUND OF THE INVENTION

1. Field of the Invention

This invention relates to solid state miniature mass spectrometers, and more particularly to a miniature mass spectrometer test system for the analysis of chemical and solid particles of either low vapor pressure chemicals or biological materials, such as toxins or spores.

2. Description of Related Art

A mass spectrometer is a device that permits rapid analysis of an unknown sample of material to be analyzed. A small amount of the sample is introduced into the mass spectrometer where it is ionized, focused and accelerated by means of magnetic and/or electric fields toward a detector array. Different ionized constituents of the sample travel along different paths to the detector array in accordance with their mass to charge ratios. The outputs from the individual detector elements of the array provide an indication of the sample's constituents.

Industrial mass spectrometers are generally large, heavy and expensive, and therefore, a need exists for a miniature, relatively inexpensive light-weight solid state mass spectrometer for use by the military, homeland security personnel, hazmat crews, industrial concerns and the like to test for the presence of dangerous substances in the immediate environment.

A typical miniature mass spectrometer is shown and described in the present assignee's U.S. Pat. No. 5,386,115 entitled "Solid State Micro-Machined Mass Spectrograph Universal Gas Detection Sensor", issued to Carl B. Freidhoff et al. on Jan. 31, 1995. Basically the miniature mass spectrometer disclosed in U.S. Pat. No. 5,386,115 is comprised of two semiconductor substrates joined together by an epoxy seal. Each half includes intricate cavities formed by a lithograph process for mounting and housing the components of the mass spectrometer.

In the above cross referenced related application U.S. Ser. No. 11/260,106, there is disclosed an improved MEMs mass spectrometer for analyzing a gas sample and comprises apparatus having metal walls connected between an elongated lid and base member fabricated on a semiconductor chip, similar to the mass spectrometer disclosed in U.S. Pat. No. 5,386,115, with the walls defining a plurality of interior chambers including sample gas input chambers, an ionizer chamber, a plurality of ion optics chambers and an ion separation chamber. A detector array at the end of the ion separation chamber includes a plurality of detector elements positioned along two parallel lines and arranged to intercept all of the ionized beams produced in the device.

SUMMARY OF THE INVENTION

The present invention is directed to the analysis of solid chemical and biological particles by a mass spectrometer test system which is adapted to operate with a minimum of support equipment and includes a vaporization chamber attached to miniature mass spectrometer apparatus for vaporizing chemical and biological particles by laser pulses, thermal pyrolysis or other energy means at pressures as high as ambient pressure or in a vacuum. The mass spectrometer apparatus includes an input collimation chamber, an internal ionization source, a mass filter and ionization chamber, drift space region, and a multi-channel array so as to permit the collection of ions formed over a wide mass range simultaneously. The particles, when desirable, can be preselected for vaporization to minimize environmental background by use of a laser induced fluorescence (LIF) detector located between the inlet nozzle and particle deflection plates. Preselection is achieved by LIF through excitation with a high energy photon, such as blue or ultraviolet, which is absorbed by the particle and partially remitted at a lower energy, such as green or red portion of the electromagnetic spectrum. Different biological and non-biological particles will have characteristic emissions. The vaporization chamber is affixed to the front end of the mass spectrometer apparatus and includes an output port adjacent an input port to the collimation and vaporization chambers so as to maximize the amount of vaporized material being fed into the mass spectrometer.

In a preferred aspect of the present invention there is provided a mass imaging spectrometer test system for analyzing solid particles of an input sample of chemical or biological material comprising: apparatus for converting solid particles of an input sample of chemical or biological materials into a vapor; miniature mass spectrometer apparatus connected to an output port of the converting apparatus for receiving vaporized samples therefrom, and wherein the spectrometer device includes a collimation chamber located adjacent the output port and having at least one vacuum pumping inlet for evacuating and drawing vapor of the sample into the collimation chamber; a vacuum pump assembly for drawing and conveying the vapor into and through the spectrometer; a repeller assembly located adjacent the collimator chamber; an ionization chamber located adjacent the repeller member for ionizing the ionized vapor input from the collimator chamber; an ion optics chamber located adjacent the collimation chamber; at least one evacuated mass filter and ion separation chamber located adjacent the ion optics chamber; an adjoining drift space region; means located in close proximity to the ion separation chamber and drift space region for generating an electromagnetic field for separating ions therein by their respective mass/charge ratio; and, a detector array for detecting ions separated in the mass filter and an ion separation chamber.

Further scope of applicability of the present invention will become apparent from the detailed description provided below. It should be understood, however, that the detailed description and the specific example, while indicating the preferred embodiment of the invention is provided by way of illustration only, since changes and modifications coming within this scope the spirit of the invention will become apparent to those skilled in the art from this detailed description.

BRIEF DESCRIPTION OF THE DRAWINGS

The present invention will become more fully understood from the detailed description provided hereinafter and the accompanying drawings which are provided by way of illustration only, and thus are not meant to be considered in a limiting sense, and wherein.

DESCRIPTION OF THE PREFERRED EMBODIMENT

Figure 1:
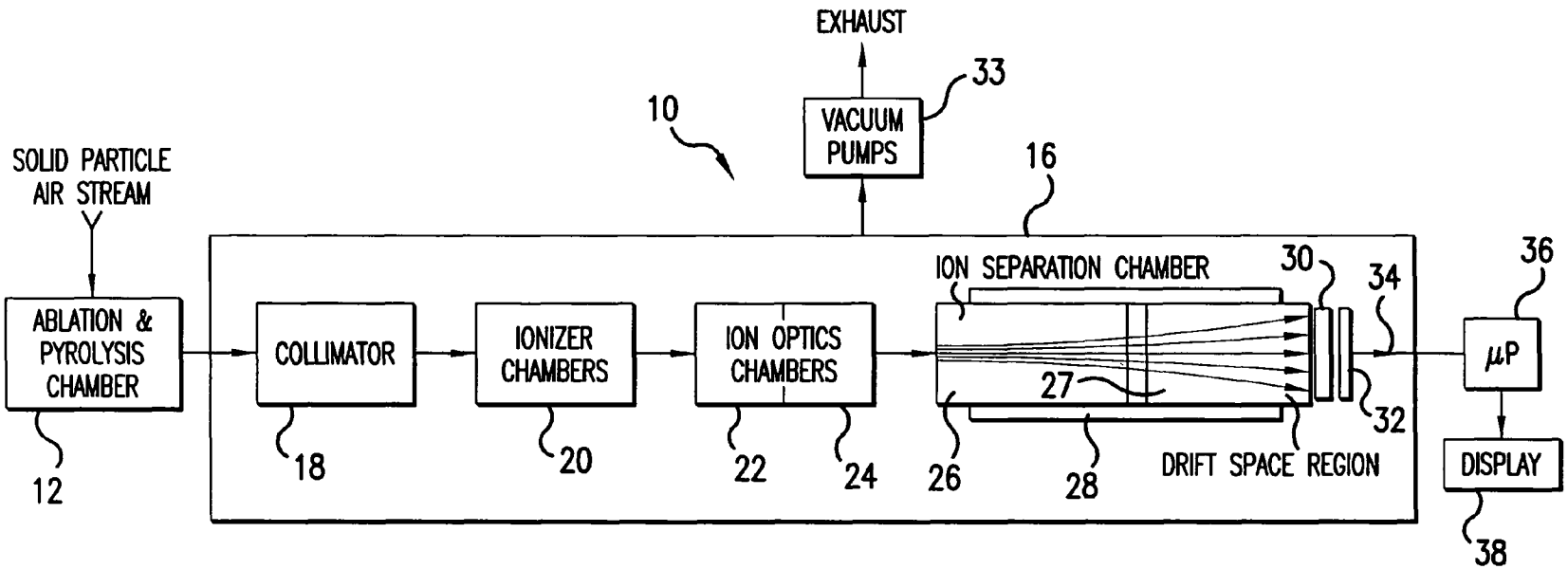
FIG. 1 is a block diagram broadly illustrative of the preferred embodiment of the subject invention.

Referring now collectively to drawing FIGS. 1-5 wherein like reference characters refer to like parts throughout, the block diagram of FIG. 1 is illustrative of miniature mass spectrometer apparatus 10 in accordance with the subject invention for the analysis of samples of solid chemical and biological particles by means of a mass spectrometer fabricated on a chip (BioMiSOC) and having solid particle vapor conversion apparatus 12 consisting of an ablation and pyrolysis chamber attached to the front end thereof for converting solid particles of an input sample to vapor. The mass spectrometer apparatus 10 of the invention is comprised of top and bottom lid and base members $\mathbf{16}_1$ and $\mathbf{16}_2$ of a semiconductor chip 16 which supports and houses a collimator chamber 18, an ionization chamber 20, first and second adjoining ion optics chambers 22 and 24, a mass filter and ion separation chamber 26, a drift space region 27, electromagnetic field generating means 28, an array 30 of detector elements, and a readout chip 32 which is coupled to a digital signal microprocessor (μP) 36 via a digital signal bus 34. Lastly, display apparatus 36 for providing a visual display of the mass spectrometer output is connected to the microprocessor 36.

Further, as shown in FIG. 1, a vacuum pump 33 is connected to the chip 16 of the mass spectrometer 16 for drawing in vapor into the collimator chamber 18 and for propagating ions formed in the ionization chamber 20 through the remaining portions of the mass spectrometer 10 to the detector array 30.

Considering now the invention in greater detail, an input sample of an air stream including solid particles of low vapor pressure chemicals or biological materials, for example, toxins or spores is fed into the vaporization-ablation chamber 12 where they are vaporized. The vapor is then fed into the collimator 18 which is differentially pumped by a pumping arrangement shown in FIG. 4. As noted above, the mass spectrometer portion 10 of the invention disclosed herein is comprised of top and bottom members $\mathbf{16}_1$ and $\mathbf{16}_2$ of a chip 16. The bottom portion $\mathbf{16}_2$, moreover, forms part of a base member 35 shown in FIG. 3, located on a substrate member 37. Both top and bottom members $\mathbf{16}_1$ and $\mathbf{16}_2$ each include an interior space or recess for the elements of opposing collimator chamber portions $\mathbf{18}_1$ and $\mathbf{18}_2$, repeller member portions $\mathbf{19}_1$ and $\mathbf{19}_2$, ionizer chamber portions $\mathbf{20}_1$ and $\mathbf{20}_2$, first and second optics portions $\mathbf{22}_1$, $\mathbf{22}_2$ and $\mathbf{24}_1$, $\mathbf{24}_2$, upper and lower mass filter and ion separation chamber portions $\mathbf{26}_1$ and $\mathbf{26}_2$, and the elements of opposing drift space regions $\mathbf{27}_1$ and $\mathbf{27}_2$.

Electric and magnetic field generation circuitry 28 is located adjacent the opposing mass filter and ion separation chamber portions $\mathbf{26}_1$, $\mathbf{26}_2$, and the drift space region portions $\mathbf{27}_1$, $\mathbf{27}_2$ and operates to generate orthogonal magnetic and electric fields for separating ions passing through of the mass filter and ionization separation chamber 26 and the drift space region 27 which then impinge on the multiple detector elements 31 of the detector array 30. A readout chip 32 then converts detected analog signals from the detector array 30 to digital signals which is then fed via a set of signal leads 34 to the microprocessor 36. The microprocessor 36 generates spectrometer output signals whereupon a visual readout is provided by the display apparatus 38.

Figure 2:
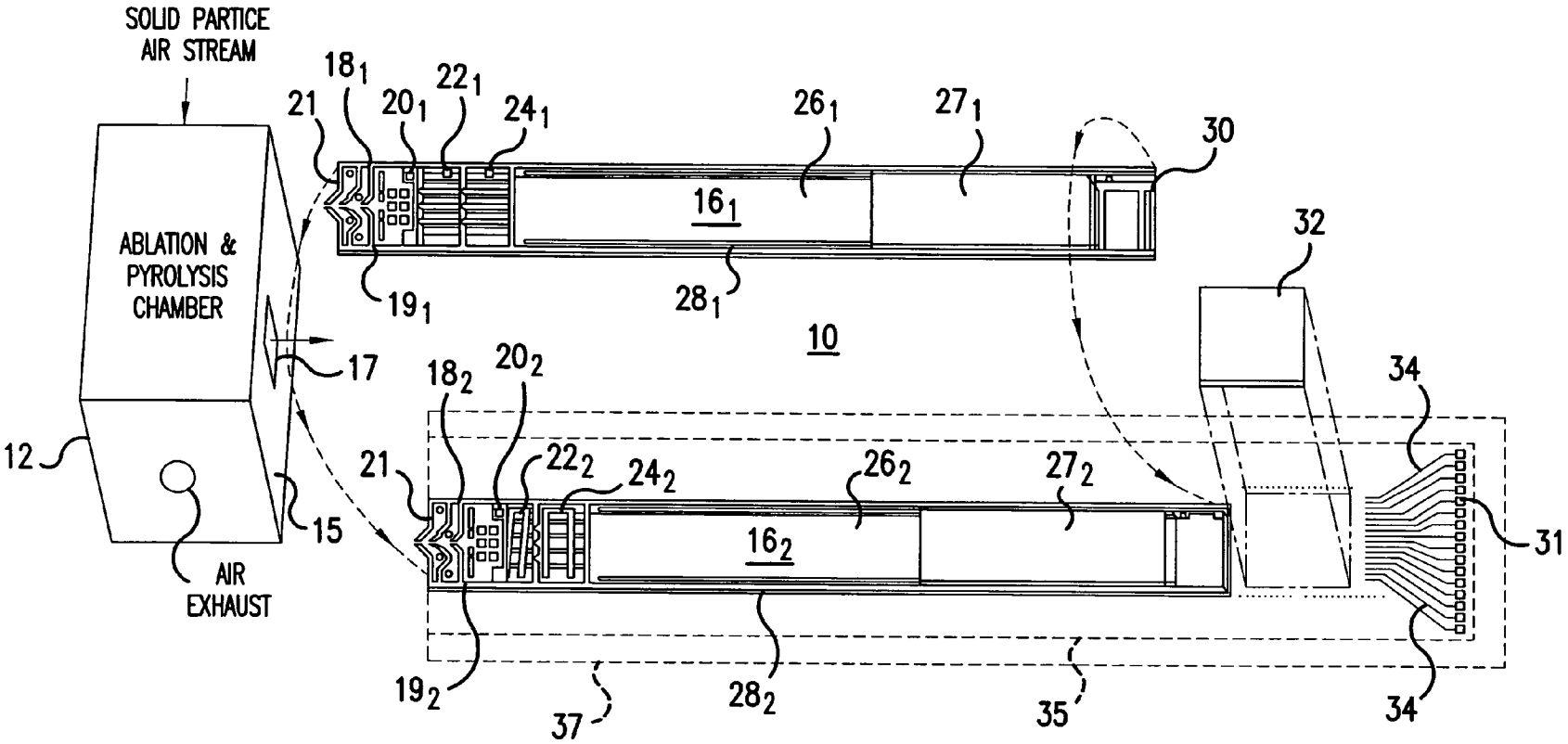
FIG. 2 is an exploded view of two halves of the preferred embodiment of the subject invention including an ablation and pyrolysis chamber.
Figure 3:
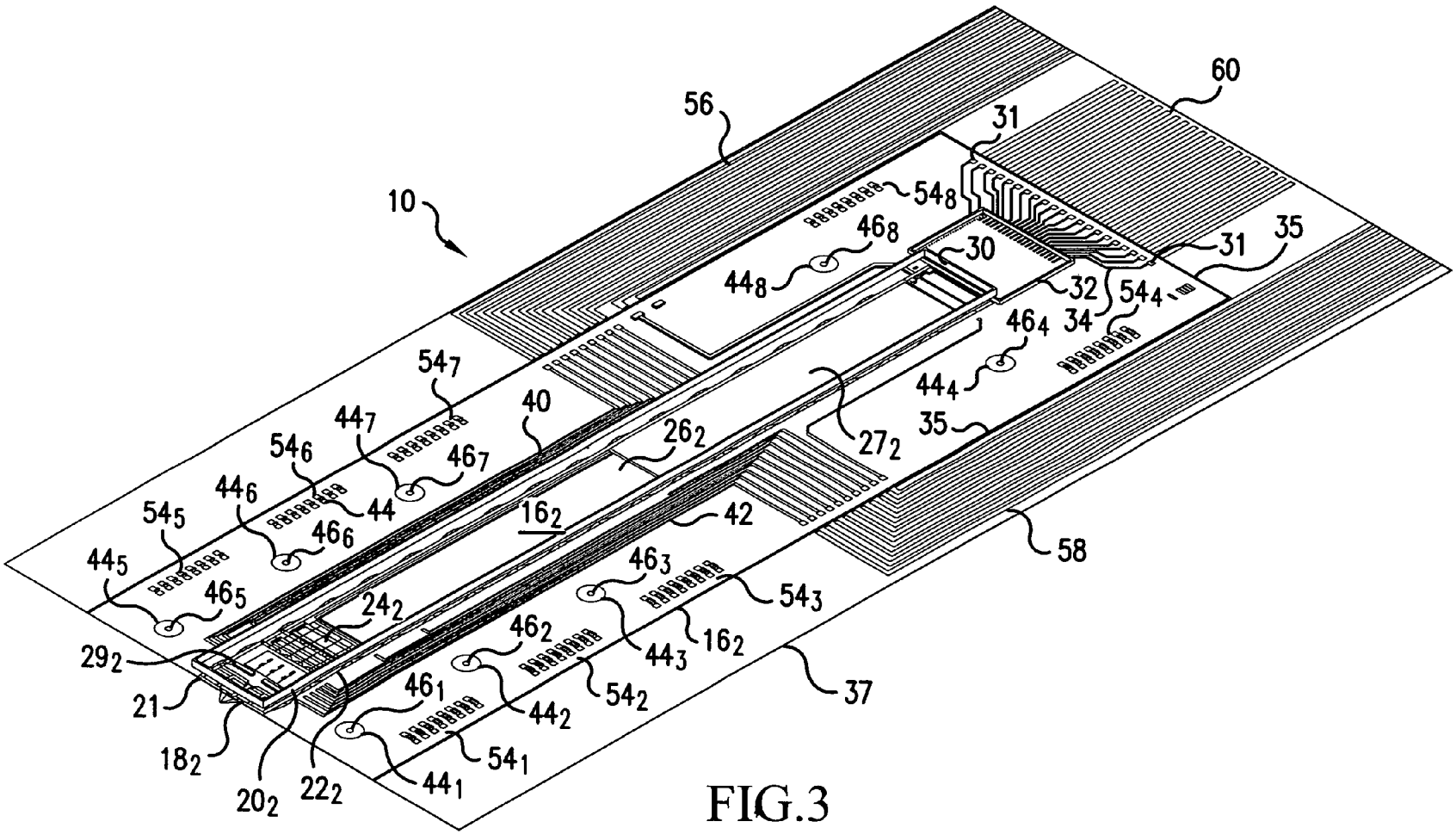
FIG. 3 is a perspective plan view illustrative of the base member of the embodiment shown in FIG. 2 adjoining a support member and substrate in accordance with the subject invention.
Figure 4:
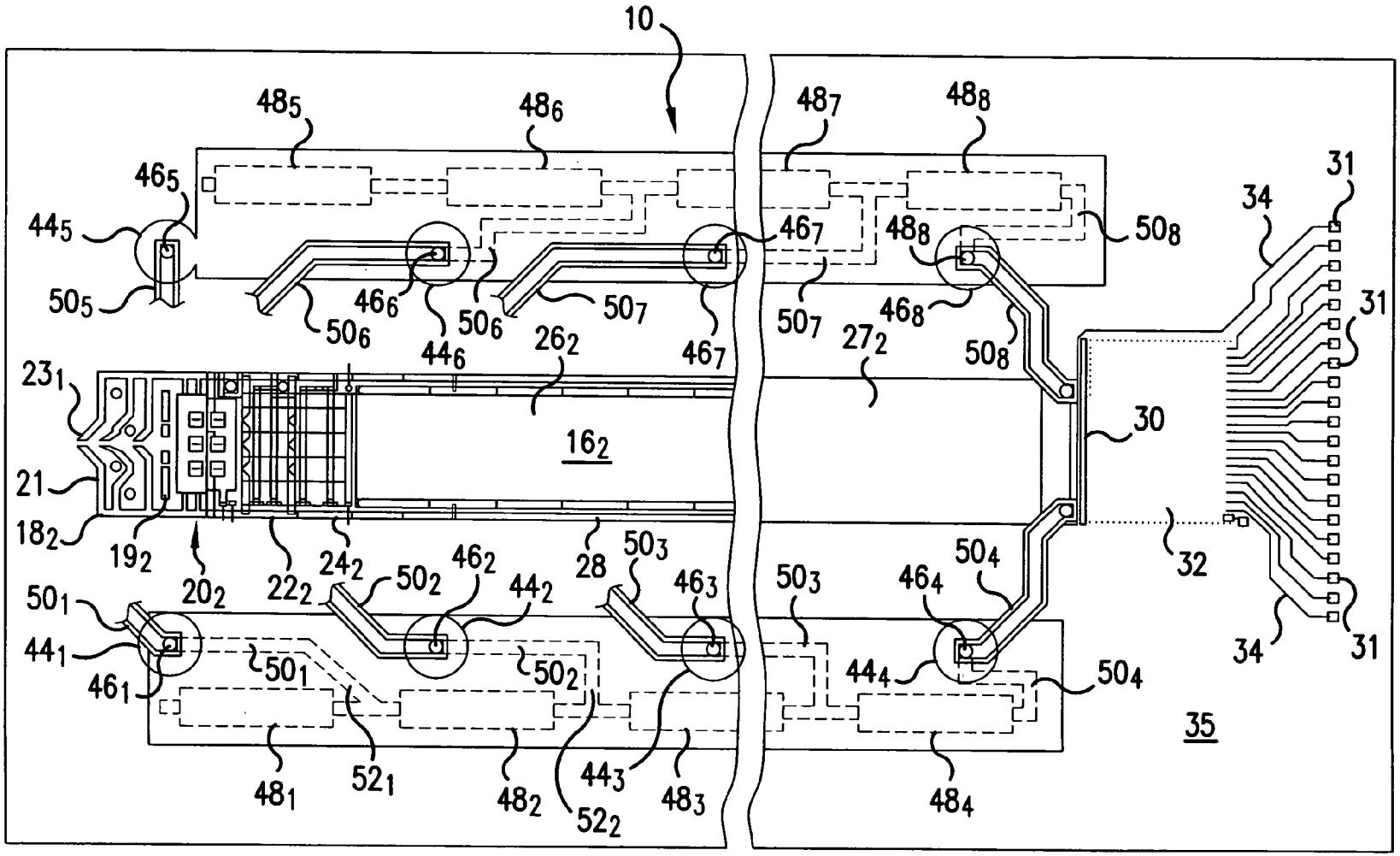
FIG. 4 is a fragmented top planar view further illustrative of the support member of the subject invention shown in FIG. 3; and, FIG. 5 is a partial perspective view illustrative of an enlarged portion of the front end portion of the subject invention including the ablation and pyrolysis chamber shown in FIG. 2.

Referring now to FIGS. 3 and 4, shown thereat is the bottom member $\mathbf{16}_2$ of the mass spectrometer portion 10 of the subject invention and corresponds substantially to the structure shown in FIG. 2. However, there is now additionally shown in FIG. 3 two sets of electrical signal leads 40 and 42 along with eight sets of solder elements $\mathbf{44}_1$, $\mathbf{44}_2$ . . . $\mathbf{44}_8$ surrounding a set of eight apertures $\mathbf{46}_1$, $\mathbf{46}_2$ . . . $\mathbf{46}_8$ which are respectively connected to eight sets of individual evacuation pumps $\mathbf{48}_1$, $\mathbf{48}_2$ . . . $\mathbf{48}_8$ shown in FIG. 4. The pumps $\mathbf{48}_1$ . . . $\mathbf{48}_8$ are connected to apertures $\mathbf{46}_1$ . . . $\mathbf{46}_8$ via pneumatic pipe members $\mathbf{50}_1$, $\mathbf{50}_2$ . . . $\mathbf{50}_8$ and $\mathbf{52}_1$, $\mathbf{52}_2$ . . . $\mathbf{52}_8$ and act to generate a vacuum environment for the propagation of ions through the length of the mass spectrometer 10 to the detector array 30. Electrical power is provided to the individual pumps $\mathbf{48}_1$, $\mathbf{48}_2$ . . . $\mathbf{48}_8$ by way of contact elements $\mathbf{54}_1$, $\mathbf{54}_2$ . . . $\mathbf{54}_8$. Also shown in FIG. 3 are three outer sets of electrical signal leads 56, 58 and 60 which are located on the base support member 35 for connecting the mass spectrometer 10 to external apparatus, not shown.

Figure 5:
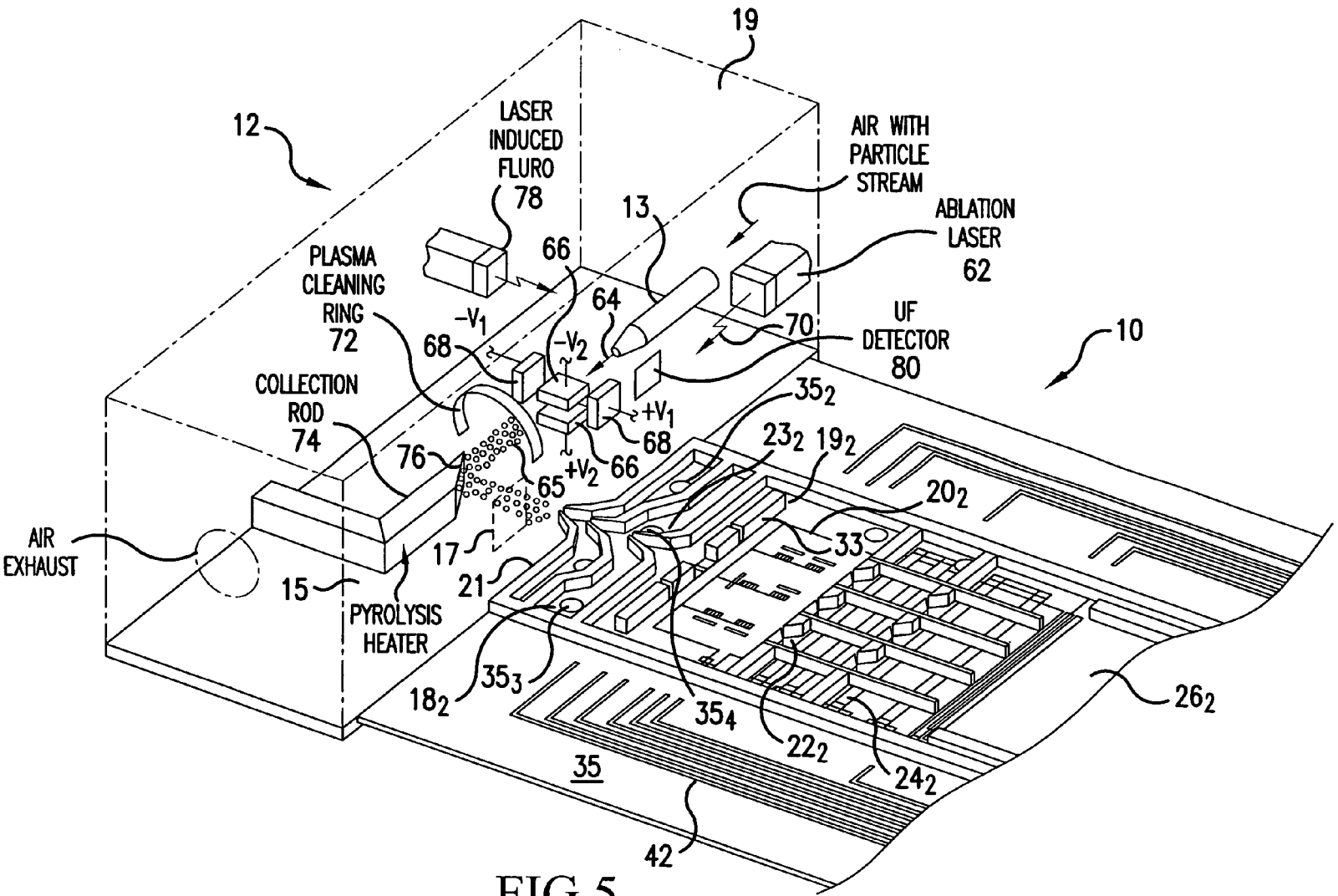

Turning attention now to FIG. 5, shown thereat are the structural details of the front end portion of the bottom member $\mathbf{16}_2$ of the mass spectrometer portion 10. FIG. 5 is intended to further illustrate the details of the ablation and pyrolysis chamber 12 and the collimator chamber portion $\mathbf{18}_2$. In FIG. 5, reference numeral 13 denotes an input nozzle 13 for feeding an input sample of air including a concentrated particle stream solid material into the chamber 12. The ablation and pyrolysis chamber 12 includes, among other things, a wall 15 having an output port 17 which mates with the front wall 21 of the collimator chamber 18.

The collimator chamber portion $\mathbf{18}_2$ includes three mutually aligned outwardly diverging pairs of collimator elements $\mathbf{23}_1$, $\mathbf{23}_2$, and $\mathbf{23}_3$ each having an open channel therebetween and terminating in a tip pointing to the output port 17 of the ablation chamber 12. The foremost pair of collimator elements $\mathbf{23}_1$, moreover, project into the output port 17 of the ablation chamber 12 so as to allow ions and vapors formed therein to be drawn into the collimator chamber 18.

In addition to the input nozzle 13 which is shown located in the side wall 19, located thereat is an ablation laser member 62 which is directed to the particle collection surface 76 downstream of the nozzle 13. In front of the nozzle 13 and in line with the particle stream 64 are two sets of deflection plate electrodes 66 and 68 which are mutually orthogonal and are adapted to deflect an ionized particle stream 65 generated by the nozzle 13 from the ablation particle collection surface 76 so that it can be selectively deflected in mutually orthogonal directions through a plasma cleaning ring 72 in front of the deflector plate electrodes 66 and 68. This permits elimination of particles of non-interest determined by a laser induced fluorescence (LIF) detector consisting of a laser member 78 and detector 80 monitoring the stream 65 in front of nozzle 13. The plasma cleaning ring 72 is ignited to form an air plasma to clean the angular collection surface 76 between samples.

This is followed by a collection rod and pyrolysis heater assembly 74 which includes an angular collection surface 76. Ablation laser member 62 is pulsed with sufficient energy to remove a portion of the deposited particles from the angular collection surface 76, or the pyrolysis heater assembly is pulsed to vaporize a portion of the deposited particles from the angular collection surface 76. The ions or vapor formed by the ablation or pyrolysis is preferentially directed through the output port 17 where it is fed into and through the collimator chamber 18 and then into the ionizer chamber 20, followed by the ion optics chambers 22 and 24 and then into the mass filter and ion separation chamber 26.

A differential vacuum pumping scheme is provided in the lower portion $\mathbf{18}_2$ of the collimator chamber 18 and includes four small circular openings $\mathbf{35}_1$, $\mathbf{35}_2$, $\mathbf{35}_3$ and $\mathbf{35}_4$ which are respectively coupled, for example, to pumps $\mathbf{48}_1$, $\mathbf{48}_2$, $\mathbf{48}_5$ and $\mathbf{48}_6$ as shown in FIG. 4. Additional stages of vacuum pumping are also provided by the pumps $\mathbf{48}_3$, $\mathbf{48}_4$, $\mathbf{48}_7$ and $\mathbf{48}_8$ so as to provide proper vacuum levels in the ablation and mass separation regions of the apparatus for producing ion movement through the spectrometer portion 10. The differentially pumped front end allows the apparatus to sample at a higher pressure regime and analyze ions formed at a lower pressure, for example, atmospheric pressure.

Thus what has been shown described is a system including a miniature mass spectrometer for analyzing solid particles of either low pressure chemicals or biological materials and allows a vapor collection region to be close to a vaporization site so as to maximize the amount of the vaporized material that enters the mass spectrometer. This allows higher pressures to be utilized, allowing the system to be potentially smaller. The miniature mass spectrometer operates at higher pressures than laboratory units due to its small length of its mass separation region (centimeters versus 10s of cm to 1 meter in lab units). This will also reduce system power and therefore size. Moreover, sensitivity can be maximized while the timing issues can be substantially eliminated. It should be noted that, when desirable, two or more mass separation channels can be utilized if additional mass range is required.

The foregoing detailed description merely illustrates the principles of the invention. It will be appreciated that those skilled in the art will be able to devise various arrangements which, although not explicitly described or shown herein, embody the principles of the invention and are thus within its spirit and scope.

What is claimed is:

1. Apparatus for analyzing solid particles of an input sample of chemical or biological material, comprising:

apparatus for converting solid particles of an input sample of chemical or biological materials into a vapor;

mass spectrometer apparatus fabricated on a semiconductor chip connected to an output port of said converting apparatus for receiving said vapor therefrom and wherein the spectrometer apparatus includes;

a collimation chamber located adjacent said output port and having at least one vacuum pumping inlet for evacuating and drawing vapor of the sample into the collimation chamber;

a vacuum pump assembly for drawing ionized vapor into and conveying the vapor through the mass spectrometer;

a repeller assembly located adjacent the collimation chamber;

an ionization chamber located adjacent the repeller assembly for ionizing the vapor being fed thereto from the collimation chamber;

an ion optics chamber located adjacent the ionization chamber;

at least one evacuated mass filter and ion separation chamber located adjacent the ion optics chamber;

a drift space region adjacent the mass filter and ion separation chamber;

means for generating an electromagnetic field in the mass filter and ion separation chamber for separating ions therein by their respective mass/charge ratio; and a detector array located adjacent the drift space region for detecting ions separated in the mass filter and an ion separation chamber and traveling through the drift space region.

2. The apparatus according to claim 1 wherein the apparatus for converting particles comprises a chamber including pyrolysis and/or ablation apparatus for vaporizing the input sample of particles.

3. The apparatus according to claim 2 and additionally including means for feeding the input sample into said chamber including the pyrolysis and/or ablation apparatus.

4. The apparatus according to claim 3 wherein said feeding means includes means located in a wall of said chamber including the pyrolysis and/or ablation apparatus for feeding the input sample in the chamber in the form of a concentrated particle stream.

5. The apparatus according to claim 4 wherein the pyrolysis apparatus is located in a path of the concentrated particle stream and includes heater means for converting the sample into a vapor and directing the vapor to said output port.

6. The apparatus according to claim 5 wherein said means for directing the vapor comprises an angulated reflecting surface.

7. The apparatus according to claim 5 and additionally including means located intermediate the pyrolysis apparatus and the means for feeding the particle stream into the chamber for deflecting the path of particle stream as it travels toward the pyrolysis apparatus.

8. The apparatus according to claim 3 wherein the ablation apparatus comprises a laser located in a wall of the chamber directed toward the input particle stream and being operable to convert the input particle stream into a plasma stream.

9. The apparatus according to claim 8 wherein the laser comprises a pulsed laser.

10. The apparatus according to claim 8 and additionally including means located in the ablation chamber forward of the laser for cleaning the plasma stream of any undesired portion of plasma stream.

11. The apparatus according to claim 10 wherein said means for cleaning the plasma stream comprises a ring type member.

12. The apparatus according to claim 2 wherein said collimator chamber includes a plurality of vacuum pump inlets for providing differential pumping in the collimation chamber.

13. The apparatus according to claim 2 wherein the collimation chamber includes at least one collimation member having an outwardly extending tip and a central opening therethrough which is inserted in the output port of said ablation chamber.

14. The apparatus according to claim 13 wherein said at least one collimation member comprises a pair of mutually facing inner wall elements which converge toward said tip.

15. The apparatus according to claim 2 wherein the collimation chamber includes an input port and a plurality of aligned collimation members having outwardly extending tips directed to said input port and said output port of said ablation chamber.

16. The apparatus according to claim 15 wherein the tip of a first collimation member of said plurality of collimation members projects into the output port of the ablation chamber.

17. The apparatus according to claim 15 wherein said collimation chamber includes a plurality of vacuum pump inlets selectively spaced adjacent the plurality of collimation members and connected to respective vacuum pumps for providing differential vacuum pumping therein.

18. The apparatus according to claim 17 wherein said plurality of collimation members comprise at least three collimation members and wherein said plurality of vacuum pump inlets and comprises at least four vacuum pump and inlets.

19. The apparatus according to claim 17 and additionally including at least one vacuum pump inlet located outside of said collimation chamber for the translating of ions through the mass spectrometer.

20. The apparatus according to claim 19 and additionally including at least one vacuum pump in the mass filter and ion separation chamber.

21. The apparatus according to claim 19 and additionally including a plurality of vacuum pump inlets and respective vacuum pumps selectively located in the mass spectrometer system downstream of the collimation chamber.

22. The apparatus according to claim 1 wherein the means for generating said electromagnetic field comprises means for generating mutually orthogonal magnetic and electric fields at least in the mass filter and ion separation chamber.

23. The apparatus according to claim 2 wherein means for generating the electromagnetic field includes means for generating orthogonal magnetic and electric fields in the region of the ion filter and separation chamber and the drift space region.

24. The apparatus according to claim 1 wherein the mass spectrometer assembly is comprised of two body members joined together along a length dimension thereof and having an elongated cavity therein in which is located components of the mass spectrometer.

* * * * *